US005178396A

United States Patent [19]

Lyon et al.

[11] Patent Number: 5,178,396

[45] Date of Patent: * Jan. 12, 1993

[54] ENCLOSURE SYSTEM

[76] Inventors: Mark D. Lyon, 3962 Denmark Ave., Eagan, Minn. 55123; Charles W. Girsch, 152 S. Avon St., St. Paul, Minn. 55105

[ * ] Notice: The portion of the term of this patent subsequent to Mar. 31, 2009 has been disclaimed.

[21] Appl. No.: 839,408

[22] Filed: Feb. 20, 1992

Related U.S. Application Data

[63] Continuation of Ser. No. 581,286, Sep. 12, 1990, Pat. No. 5,100,151.

[51] Int. Cl.[5] ..... A63F 3/00; B65D 5/10

[52] U.S. Cl. ..... 273/285; 229/103; 229/112; 229/115; 206/315.1

[58] Field of Search ..... 273/285, 286, 287; 229/103, 112, 115, 108.1, 190, 186, 187; 446/488; 206/315.1

[56] References Cited

U.S. PATENT DOCUMENTS

| | | | |
|---|---|---|---|
| 509,316 | 11/1893 | Lapham | 273/286 |
| 715,794 | 12/1902 | Haskell | 273/287 |
| 724,760 | 4/1903 | Van Altena | 273/286 |
| 1,467,690 | 9/1923 | Schwarz | 273/286 |
| 1,793,256 | 2/1931 | Shulman | 273/285 |
| 2,147,900 | 2/1939 | Houseknecht | 273/285 |
| 2,349,589 | 5/1944 | Harrington | 229/115 |
| 2,667,353 | 1/1954 | Lanice | 273/286 |
| 3,175,683 | 3/1965 | Billing | 229/115 |
| 3,653,576 | 4/1972 | Stranicky | 229/22 |
| 4,281,788 | 8/1981 | Aeba | 229/22 |
| 4,709,928 | 12/1987 | Willingham | 273/389 |

FOREIGN PATENT DOCUMENTS

| | | | |
|---|---|---|---|
| 378442 | 8/1922 | Fed. Rep. of Germany | 273/285 |
| 7411303 | 2/1976 | Netherlands | 273/285 |
| 2194452 | 3/1988 | United Kingdom | 273/285 |

*Primary Examiner*—Benjamin H. Layno
*Attorney, Agent, or Firm*—Kinney & Lange

[57] ABSTRACT

A folding game board system is provided for use with game pieces. The system includes a flat game board. The game board has a plurality of side wall panels and a plurality of end panels. Each of the side wall panels is hinged to an adjacent side wall panel and each of the end panels is hinged to at least one of the side wall panels whereby the game board folds into a container. The container forms an enclosure for holding and storing the game pieces.

29 Claims, 6 Drawing Sheets

ENCLOSURE SYSTEM

This is a continuation of application Ser. No. 07/581,286, filed Sep. 12, 1990 now U.S. Pat. No. 5,100,151.

BACKGROUND OF THE INVENTION

The present invention relates to board games having a collapsible board, and, in particular, it relates to a flat game board which folds into a container forming an enclosure for holding and storing game pieces associated with the board game.

In the past, a number of folding game boards, i.e., game boards capable of being folded into a reduced size, have been marketed. Generally, the game board is made of relatively stiff material, with portions hinged together so that the game board is folded flat when the game has been completed. Once the game board is folded, the game board and all the game pieces associated with the game board are placed in a separate box or container. Eventually, the box becomes worn and begins to fall apart with the game pieces becoming lost or misplaced.

Patents which describe folding board games are Shulman U.S. Pat. No. 1,793,256 and Houseknecht U.S. Pat. No. 2,147,900. The Shulman patent describes a foldable checkerboard having compartments for removably receiving drawers or receptacles containing checkers which are used in conjunction with the board. The checkerboard may also have a set of pockets for receiving a set of dominoes. The board is foldable upon itself and is provided with a mechanism for securing the free ends together to prevent the displacement or loss of the checkers.

The Houseknecht patent describes a game board consisting of four hingedly connected sections with two of the sections having their bottom faces recessed. The recessed sections jointly form a container when the board is folded for storing the pieces used in conjunction with the game board.

SUMMARY OF THE INVENTION

The present invention includes a folding game board system having game pieces. The system includes a flat game board. The game board has a plurality of side wall panels and a plurality of end panels. Each of the side wall panels is hinged to an adjacent side wall panel and each of the end panels is hinged to at least one of the side wall panels. The game board folds into a container forming an enclosure for holding and storing the game pieces associated with the game board.

The game board of the present invention has a playing side and back side. Preferably, a game playing surface overlays the playing side of the game board such that the game playing surface hingedly connects each side wall panel to an adjacent side wall panel and each end panel to at least one of the side wall panels. In one embodiment, a back surface overlays the back side of the game board with the back surface being connected to the game playing surface between each of the side wall panels. In yet another embodiment, the playing surface and the back surface also hinge each of the end panels to at least one of the side wall panels.

In one embodiment, the side wall panels and the end panels are formed from a single sheet of material. The side wall panels are hinged to an adjacent side wall panel by fold lines. In addition, the end panels are hinged to at least one side wall panel by fold lines.

Figure 9:
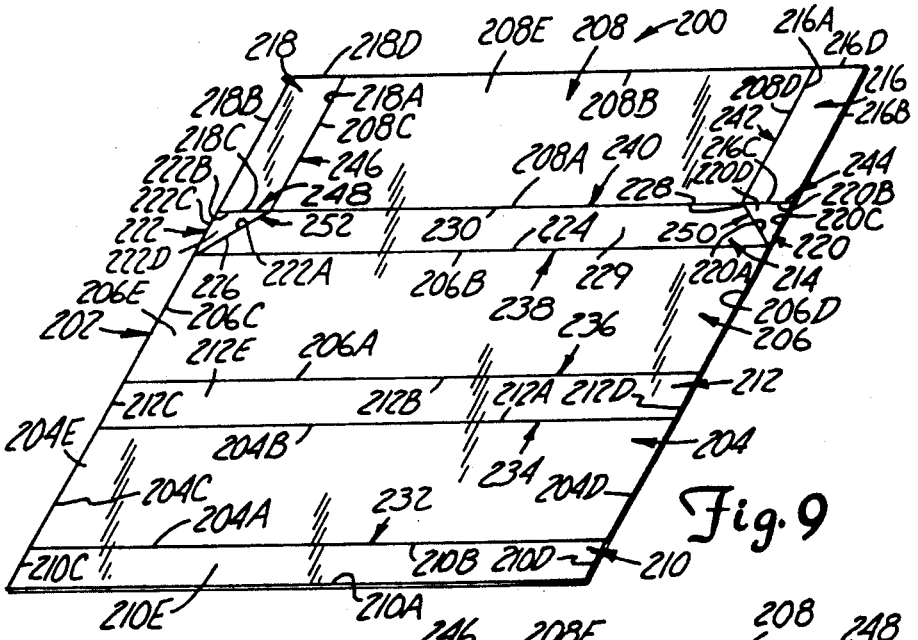
FIG. 9 is a perspective view of a third embodiment of the folding game board of the present invention prior to folding.
Figure 10:
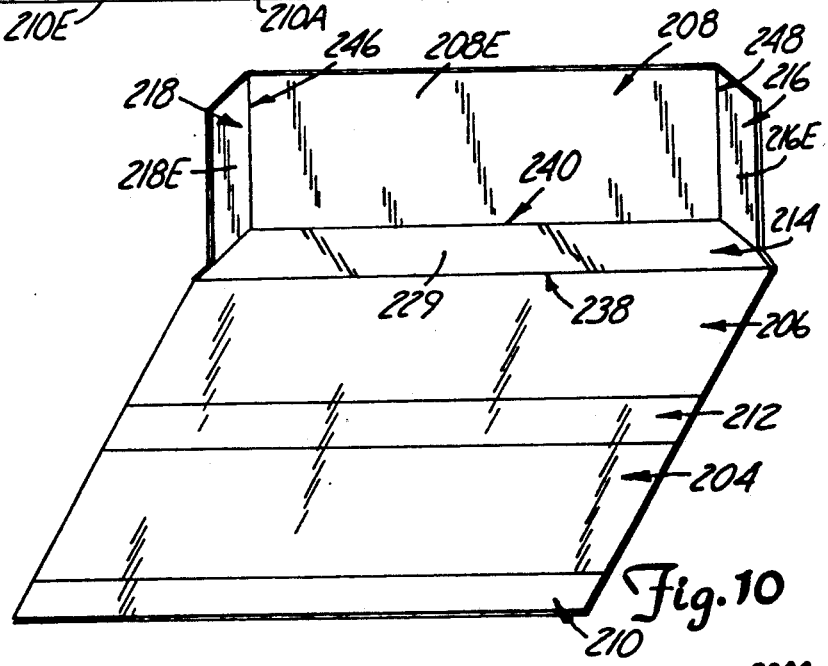
FIG. 10 is a perspective view illustrating the positioning of the end panels and the gusset panels during an initial folding step of the game board of FIG. 9.
Figure 13:
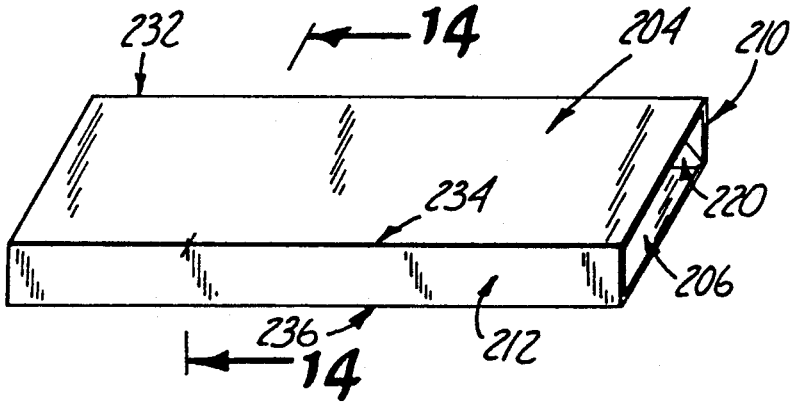
Figure 14:
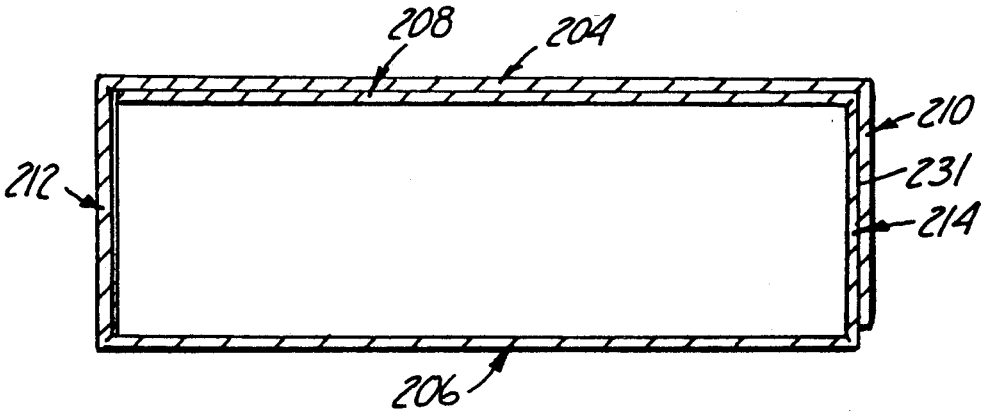
Figure 15:
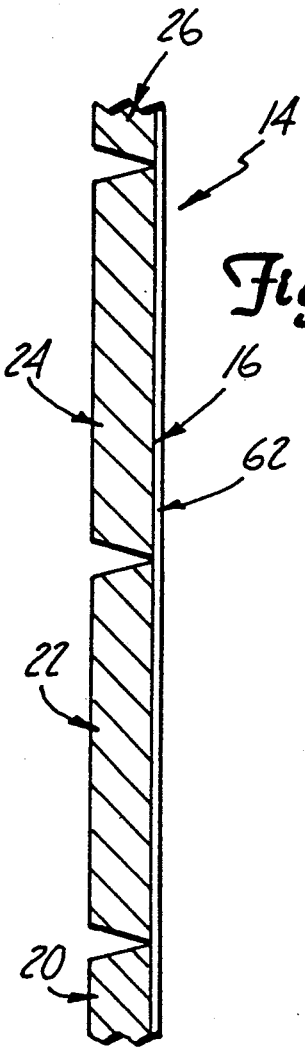
Figure 17:
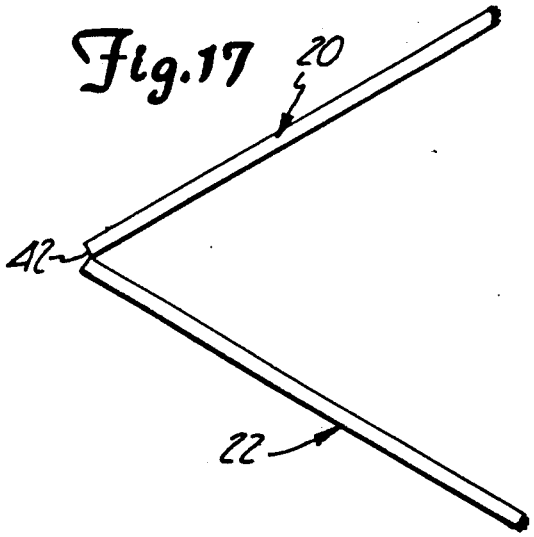
Figure 16:
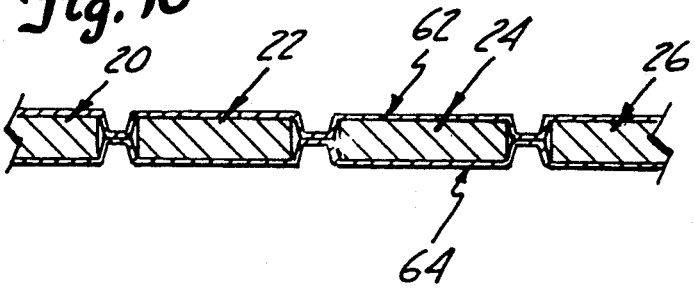

FIGS. and 12 are perspective views illustrating subsequent folding steps of the game board of FIG. 10;

FIG. 13 is a perspective view illustrating the folding game board of FIG. 9 in a folded configuration;

FIG. 14 is a cross-sectional view taken along line 14—14 of FIG. 13;

FIG. 15 is a cross-sectional view of a hinge connection between the side wall panels of the game board system of the present invention;

FIG. 16 is a cross-sectional view of the fold line between the side wall panels of the game board system of the present invention; and FIG. 17 is a sectional view of yet another embodiment of the present invention wherein the side wall panels and the end panels are connected to the game board by fold lines.

DETAILED DESCRIPTION OF THE PREFERRED EMBODIMENTS

Figure 1:
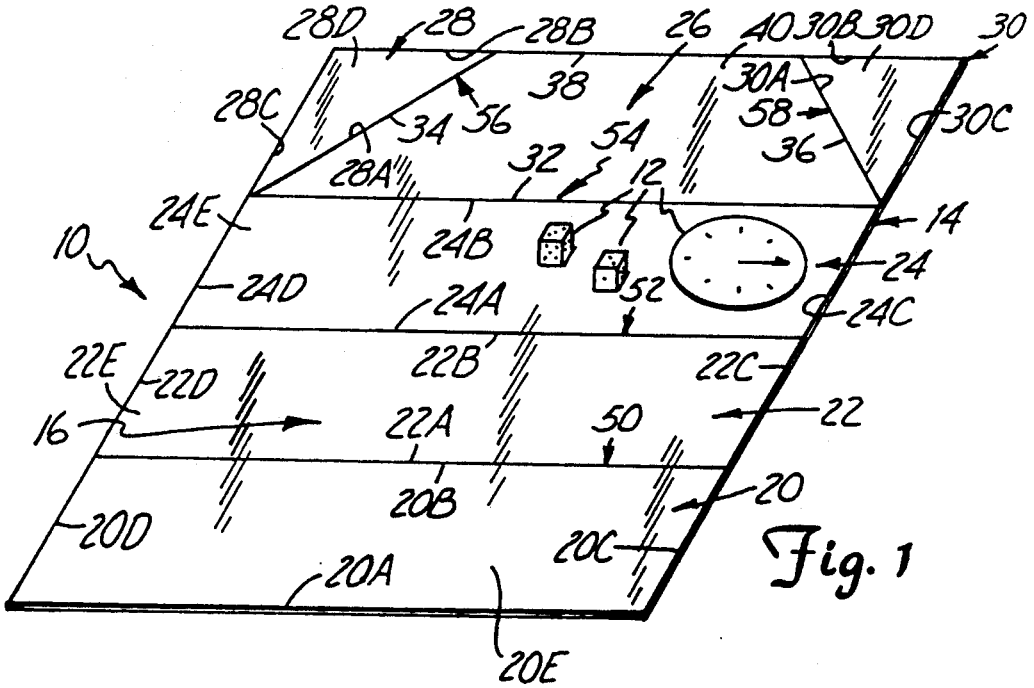
FIG. 1 is a perspective view of a first embodiment of the folding game board of the present invention prior to folding.

The folding game board system of the present invention is generally indicated at 10 in FIG. 1. The game board system 10 includes various game pieces 12 associated with the game board system 10. The quantity and characteristics of the game pieces 12 are determined by the type of game the game board system 10 is designed to incorporate. Therefore, the game pieces 12 include, but are not limited to, dice, spinners, cards, movable playing parts, and the like.

The game board system 10 includes a flat game board 14. The game board 14 is constructed of any suitable sheet-type material. The material includes, but is not limited to, fiber board, corrugated cardboard, posterboard material and the like.

Figure 3:
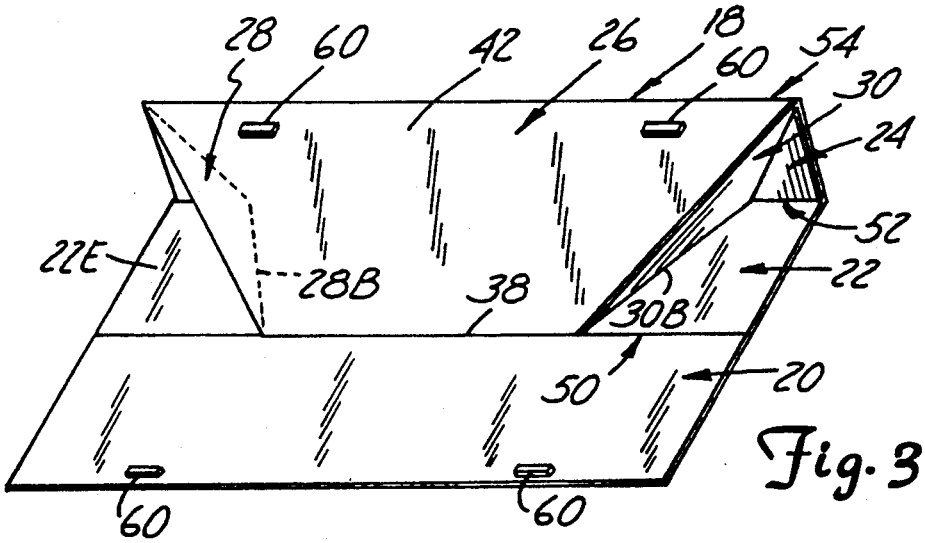
FIG. 3 is a perspective view illustrating the subsequent folding step of the game board of FIG. 2.

The game board 14 includes a playing side 16 and a back side 18, as best illustrated in FIG. 3. The playing side 16 is preferably that side of the game board 14 on which the game will be conducted. The back side 18 is the side opposite the playing side 16.

Figure 6:
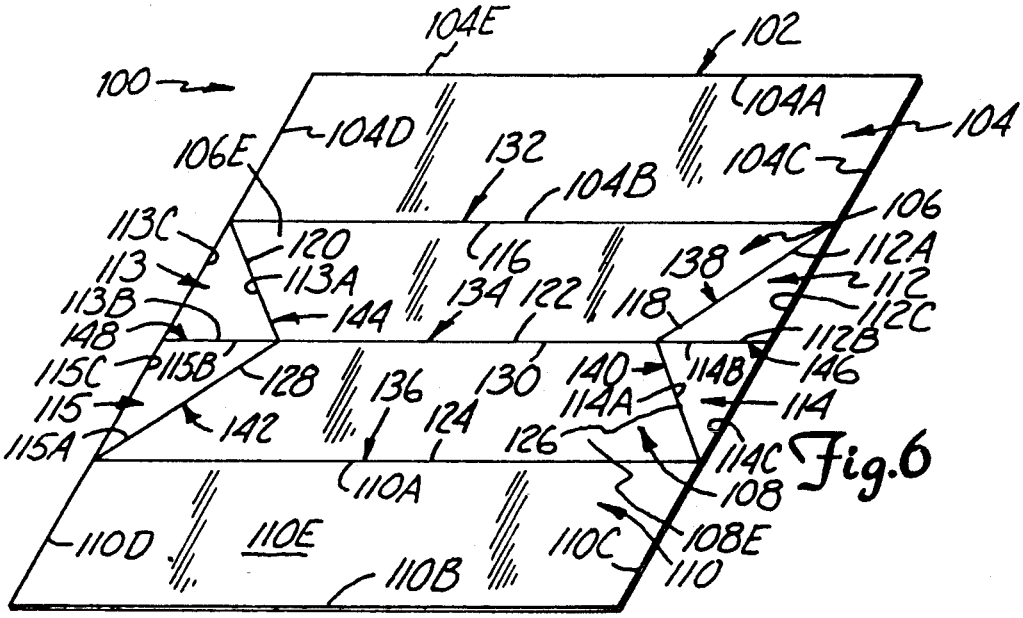
FIG. 6 is a perspective view of a variation of the folding game board of FIGS. 1–5 of the present invention prior to folding.
Figure 11:
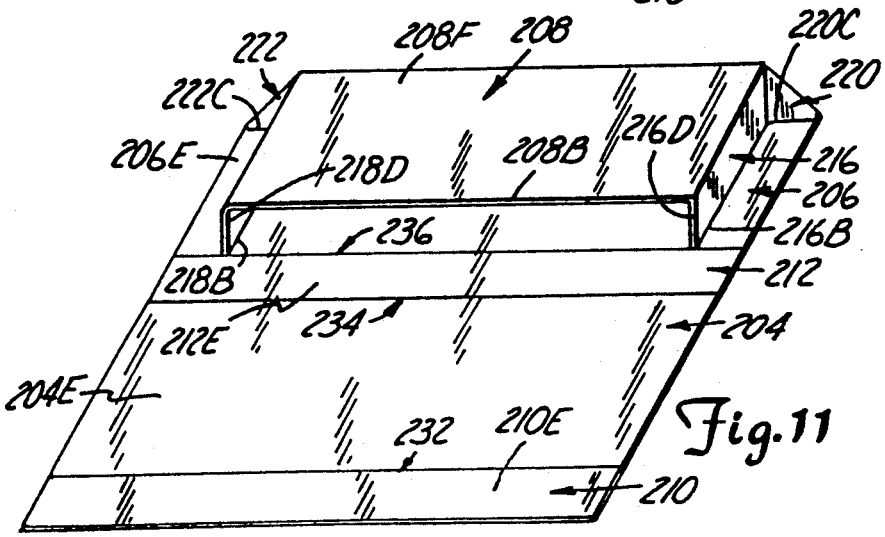

Referring to FIG. 1, the game board 14 includes a plurality of side wall panels 20, 22, 24, 26, and a plurality of end panels 28, 30. The entire game board 14 including the side wall panels 20, 22, 24, 26, and the end panels 28, 30 is preferably assembled from single piece of material. This single piece assemblage reduces material waste by eliminating the need for a box, as best illustrated in FIGS. 1, 6 and 11.

Figure 5:
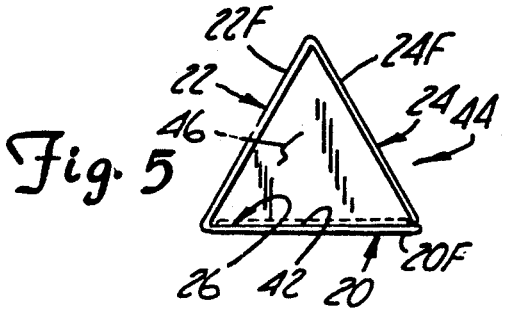
FIG. 5 is an end view of the present invention after folding.

In one preferred embodiment, the side wall panels 20, 22, 24 are substantially rectangular in shape as is illustrated in FIG. 1. The side wall panel 20 includes a plurality of panel edges 20A, 20B, 20C, 20D and a playing side 20E. The side wall panel 20 also includes a back side 20F as is illustrated in FIG. 5. Referring to FIG. 1, the panel edge 20A is substantially opposite and parallel to the panel edge 20B, and the panel edge 20C is substantially opposite and parallel to the panel edge 20D.

The side wall panel 22 includes a plurality of panel edges 22A, 22B, 22C, 22D and a playing side 22E. The side wall panel 22 also includes a back side 22F as is illustrated in FIG. 5. Referring to FIG. 1, the panel edge 22A is substantially opposite and parallel to the panel edge 22B and the panel edge 22C is substantially opposite and parallel to the panel edge 22D.

The side wall panel 24 includes a plurality of panel edges 24A, 24B, 24C, 24D and a playing side 24E. The side wall panel 24 also includes a back side 24F as is illustrated in FIG. 5. The panel edge 24A is substantially opposite and parallel to the panel edge 24B and the panel edge 24C is substantially opposite and parallel to the panel edge 24D.

Preferably, the panel edges 20A, 20B of the side wall panel 20 have a length substantially equal to the length of the panel edges 22A, 22B of the side wall panel 22. Additionally, the panel edges 22A, 22B of the side wall panel 22 have a length substantially equal to the length of the panel edges 24A, 24B of the side wall panel 24.

In addition, preferably, the panel edges 20C, 20D have a length substantially equal to approximately 0.268 times the length of the panel edge 20A. Furthermore, the panel edges 22C, 22D preferably have a length substantially equal to the length of the panel edges 24C, 24D and is substantially equal to approximately 0.232 times the length of the panel edge 20A.

The side wall panel 26 is substantially trapezoidal in shape and has a base edge 32, a pair of side edges 34, 36, a top edge 38 and a playing side 40. The side wall panel 26 also includes a back side 42 as is illustrated in FIG. 3. Referring to FIG. 1, the side edge 34 is approximately the same length as the side edge 36 and the top edge 38 has a length shorter than the length of the base edge 32. In addition, the base edge 32 has a length substantially equal to the length of the panel edge 24B of the side wall panel 24. The distance between the base edge 32 and the top edge 38 is substantially equal to the length of the panel edges 20C, 20D and is approximately 0.268 times the length of the panel edge 20A.

Figure 2:
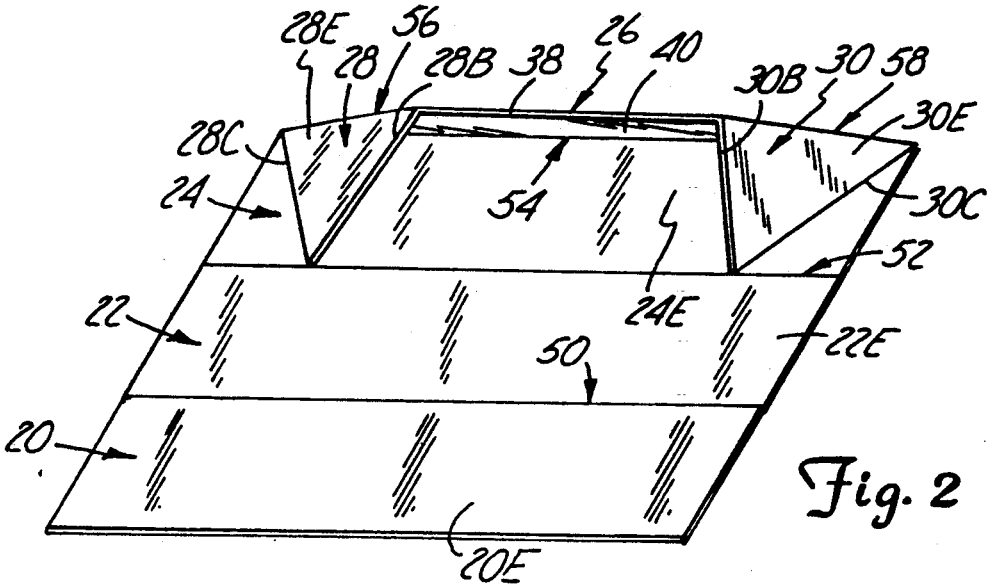
FIG. 2 is a perspective view illustrating the positioning of the end panels during an initial folding process step of the board of FIG. 1.

The end panels 28, 30 in the first embodiment are substantially right triangular in shape. The end panel 28 has a plurality of end panel edges 28A, 28B, 28C and a playing side 28D. The end panel 28 also includes a back side 28E as is illustrated in FIG. 2. Referring to FIG. 1, the end panel 30 has a plurality of end panel edges 30A, 30B, 30C and a playing side 30D. The end panel 30 also includes a back side 30E as is illustrated in FIG. 2. Referring to FIG. 1, the end panel edge 28A has a length substantially equal to the length of the side edge 34 of the side wall panel 26 and the panel edge 30A has a length substantially equal to the length of the side edge 36 of the side wall panel 26. In addition, the end panel edges 28B, 28C have a length substantially equal to the length of the end panel edges 30B, 30C. Furthermore, the end panel edges 28B, 28C, 30B, 30C have a length substantially equal to the length of the panel edges 20C, 20D which is approximately 0.268 times the length of the panel edge 20A. The angle between the panel edge 28A and the base edge 32 is approximately 45°; the angle between the end panel edge 30A and the base edge 32 is approximately 45°.

To form the game board system 10 according to the present invention, the side wall panels are preferably hingedly connected to each adjacent side wall panel. First, the panel 20 is hinged to the panel 22 along the panel edge 20B and the panel edge 22A forming a hinge line 50. Second, the panel 22 is hinged to the panel 24 along the panel edge 22B and the panel edge 24A forming a hinge line 52. Finally, the panel 24 is hinged to the panel 26 along the panel edge 24B and the base edge 32 forming a hinge line 54.

In addition to connecting the side wall panels as detailed above, the end panels 28, 30 are preferably hinged to the side wall panel 26 in a similar fashion. The end panel 28 is hinged to the side panel 26 along the end panel edge 28A and the side edge 34 forming a hinge line 56. The end panel 30 is hinged to the side panel 26 along the end panel edge 30A and the side edge 36 of the side wall panel 26 forming a hinge line 58.

Figure 4:
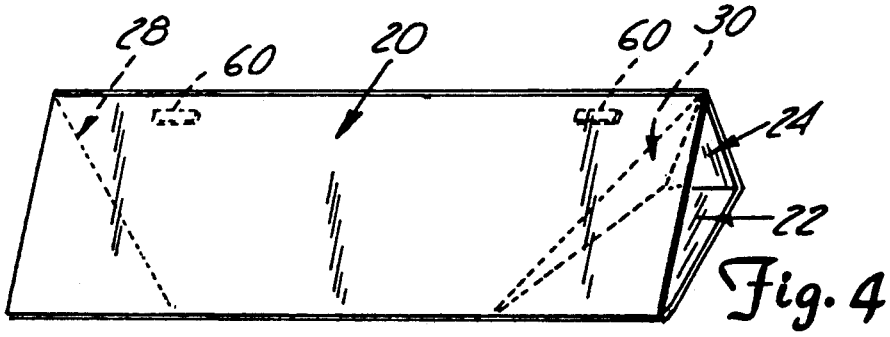
FIG. 4 is a perspective view illustrating the folding game board of FIG. 1 in a folded configuration.

As illustrated in FIG. 2, the end panels 28, 30 are hinged to the side wall panel 26 such that the end panels 28, 30 fold upwardly and inwardly toward the playing side 40 of side wall panel 26 along the hinge lines 56, 58, respectively. As the end panels 28, 30 are folded upwardly along the hinge lines 56, 58, the side wall panel 26 is folded upwardly along the hinge line 54 until the end panel edges 28C, 30C rest against the playing side 24E of the side wall panel 24. Next, as illustrated in FIG. 3, the side wall panel 24 is folded upwardly along the hinge line 52 until the end panel edges 28B, 30B and the top edge 38 rest against the playing side 22E of the side wall panel 22. Finally, as illustrated in FIG. 4, the side wall panel 20 is folded upwardly along the hinge line 50. As illustrated in FIG. 5, after this folding step, the playing side 20E of the side wall panel 20 rests against the back side 42 of the side wall panel 26.

In one preferred embodiment, a hook and loop fastener 60, as best illustrated in FIG. 3, is provided on the back side 42 of the side wall panel 26 and the playing side 20E such that the game board 14 is secured in a closed position to prevent the side wall panels 20, 22, 24, 26 from unfolding. The fastener 60 includes, for example, snaps or buckles, although any type of fastening mechanism may be used as the fastener 60.

The method of folding the game board system 10 of the present invention, as illustrated in FIG. 4, allows the side wall panels 20, 22, 24, 26 and the end panels 28, 30 to fold into a container 44 forming an enclosure 46 for holding and storing the game pieces 12 associated with the game board 14. The end panels 28, 30 form end walls which prevent t he game pieces 12 from leaving the enclosure 46. In the first embodiment, the container 44 forms a triangular cross-sectional configuration as is illustrated in FIG. 5.

The game board system thus described has been for a game board having four side wall panels and two end panels. However, it is within the scope of this invention to have a game board system which includes any number of side wall panels and any number of end wall panels.

Figure 7:
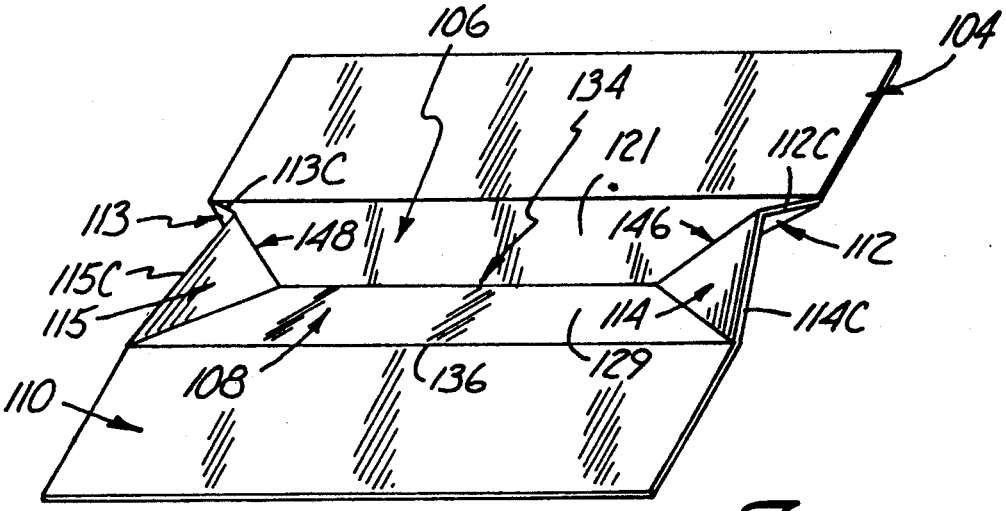
FIG. 7 is a perspective view illustrating the positioning of end panels and interior side wall panels during an initial folding step of the game board of FIG. 6.
Figure 8:
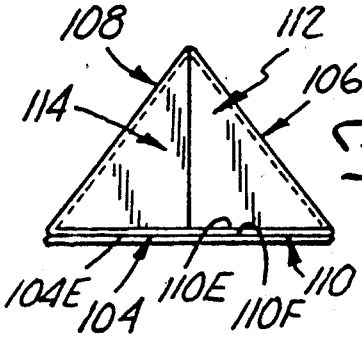
FIG. 8 is an end view of the game board of the present invention.

In a second embodiment, a game board system generally indicated at 100, is illustrated in FIGS. 6–8. Referring to FIG. 6, a game board 102 includes a plurality of side wall panels 104, 106, 108, 110, and a plurality of end panels 112, 113, 114, 115. As in the first preferred embodiment described above, the entire game board 102 including the side wall panels 104, 106, 108, 110, and the end panels 112, 113, 114, 115 may be assembled from one piece of material thereby reducing material waste.

The side wall panels 104, 110 are generally rectangular in shape. The side wall panel 104 includes a plurality of panel edges 104A, 104B, 104C, 104D and a playing side 104E. The side wall panel 104 also includes a back side 104F as is illustrated in FIG. 8. The panel edge 104A is substantially opposite and parallel to the panel edge 104B and the panel edge 104C is substantially opposite and parallel to the panel edge 104D.

The side wall panel 110 includes a plurality of panel edges 110A, 110B, 110C, 110D and a playing side 110E. The side wall panel 110 also includes a back side 110F as is illustrated in FIG. 8. The panel edge 110A is substantially opposite and parallel to the panel edge 110B and the panel edge 110C is substantially opposite and parallel to the panel edge 110D.

Preferably, the panel edges 104A, 104B have a length substantially equal to the length of the panel edges 110A, 110B. In addition, preferably, the panel edges 104C, 104D have a length substantially equal to the length of the panel edges 110C, 110D which is approximately 0.25 times the length of the panel edge 104A.

The side wall panels 106, 108 are substantially trapezoidal in shape. The side wall panel 106 has a base edge 116, a pair of side edges 118, 120, a top edge 122 and a playing side 121. The side edge 118 is approximately the same length as the side edge 120 and the top edge 122 has a length shorter than the length of the base edge 116. In addition, the base edge 116 has a length substantially equal to the length of the panel edge 104B and the distance between the base edge 116 and the top edge 122 is substantially equal to 0.25 times the length of the panel edge 104A.

The side wall panel 108 has a base edge 124, a pair of side edges 126, 128, a top edge 130 and a playing side 129. The side edge 126 is approximately the same length as the side edge 128 and the top edge 130 has a length shorter than the length of the base edge 124. In addition, the base edge 124 has a length substantially equal to the length of the panel edge 110A and the distance between the base edge 124 and the top edge 130 is substantially equal to 0.25 times the length of the panel edge 104A.

The end panels 112, 113, 114, 115 in the second preferred embodiment are substantially triangular in shape. The end panel 112 includes a plurality of end panel edges 112A, 112B, 112C. The end panel edge 112A has a length substantially equal to the length of the side edge 118 of the side wall panel 106.

The end panel 113 includes a plurality of end panel edges 113A, 113B, 113C. The end panel edge 113A has a length substantially equal to the length of the side edge 120 of the side wall panel 116.

The end panel 114 includes a plurality of end panel edges 114A, 114B, 114C. The end panel edge 114A has a length substantially equal to the length of the side edge 126 of the side wall panel 108.

The end panel 115 includes a plurality of end panel edges 115A, 115B, 115C. The end panel edge 115A has a length substantially equal to the length of the side edge 128 of the side wall panel 108.

The end panels 112, 113, 114, 115 are preferably in the form of a right triangle with the end panel edges 112B, 113B, 114B, 115B being substantially equal length which is approximately equal to 0.866 times the length of the panel edge 112C, 113C, 114C, or 115C. In addition, the end panel edges 112C, 113C, 114C, 115C are substantially equal in length.

Preferably, the angle between the end panel edge 114A and the base edge 124 is approximately 49°. In addition, preferably the angle between the end panel edge 115A and the base edge 124 is approximately 49°. The angle between the end panel edge 113A and the base edge 116 is preferably approximately 49°. Furthermore, preferably the angle between the end panel edge 112A and the base edge 116 is approximately 49°.

To form the game board system 100 of the second preferred embodiment of the present invention, the side wall panels are preferably hingedly connected to each adjacent side wall panel. First, the side wall panel 104 is hinged to the side wall panel 106 along the panel edge 104B and the base edge 116 forming a hinge line 132. Second, the side wall panel 106 is hinged to the side wall panel 108 along the top edge 122 and the top edge 130 forming a hinge line 134. Finally, the side wall panel 108 is hinged to the side wall panel 110 along the base edge 124 and the panel edge 110A forming a hinge line 136.

In addition to hingedly connecting the side wall panels as detailed above, the end panel 112 is preferably hinged to the side wall panel 106 along the end panel edge 112A and the side edge 118 forming a hinge line 138. The end panel 114 is preferably hinged to the side wall panel 108 along the end panel edge 114A and the side edge 126 forming a hinge line 140. Additionally, the end panel 112 is preferably hinged to the end panel 114 along the end panel edge 112B and the end panel edge 114B forming a hinge line 146.

The end panel 113 is preferably hinged to the side wall panel 106 along the end panel edge 113A and the side edge 120 forming a hinge line 144. The end panel 115 is preferably hinged to the side wall panel 108 along the end panel edge 115A and the side edge 128 forming a hinge line 142. Furthermore, the end panel 113 is preferably hinged to the end panel 115 along the end panel edge 113B and the end panel edge 115B forming a hinge line 148.

To fold the game board system 100 of the second preferred embodiment of the present invention, as illustrated in FIG. 7, the end panels 112, 113, 114, 115 are folded upwardly along the hinge lines 146, 148. At the same time, the side wall panels 106, 108 are folded upwardly along hinge line 134 such that the playing side 121 of the side wall panel 106 faces toward the playing side 129 of the side wall panel 108. The side wall panel 110 is then folded upwardly along the hinge line 136 until the playing side 110E of the side wall panel 110 rests against the end panel edges 112C, 113C, 114C, 115C, as illustrated in FIG. 8. Finally, the side wall panel 104 is folded upwardly along the hinge line 132 until the playing side 104E of the side wall panel 104 rests against the back side 110F of the side wall panel 110.

The folded configuration of the game board 102 of the second preferred embodiment provides a game board system 100 having a triangular cross-section similar to the first embodiment as best illustrated in FIG. 8.

In a third embodiment of the present invention, a game board system 200 is best illustrated in FIGS. 9–14. The game board system includes a game board 202 with a plurality of side wall panels 204, 206, 208, a plurality of adjacent wall panels 210, 212, 214, a plurality of end panels 216, 218 and a plurality of triangular inserts or gusset panels 220, 222. The side wall panels 204, 206, 208, the adjacent wall panels 210, 212 and the end panels 216, 218 are generally rectangular in shape as best illustrated in FIG. 9.

The side wall panel 204 includes a plurality of panel edges 204A, 204B, 204C, 204D and a playing side 204E. The panel edge 204A is substantially opposite and parallel to the panel edge 204B and the panel edge 204C is substantially opposite and parallel to the panel edge 204D.

The side wall panel 206 includes a plurality of panel edges 206A, 206B, 206C, 206D and a playing side 206E. The panel edge 206A is substantially opposite and parallel to the panel edge 206B and the panel edge 206C is substantially opposite and parallel to the panel edge 206D.

The side wall panel 208 includes a plurality of panel edges 208A, 208B, 208C, 208D and a playing side 208E. The side wall panel 208 also includes a back side 208F as is illustrated in FIG. 11. Referring to FIG. 9, the panel edge 208A is substantially opposite and parallel to the panel edge 208B and the panel edge 208C is substantially opposite and parallel to the panel edge 208D.

The adjacent wall panel 210 includes a plurality of panel edges 210A, 210B, 210C, 210D and a playing side 210E. The panel edge 210A is substantially opposite and parallel to the panel edge 210B and the panel edge 210C is substantially opposite and parallel to the panel edge 210D.

The adjacent wall panel 212 includes a plurality of panel edges 212A, 212B, 212C, 212D, and a playing side 212E. The panel edge 212A is substantially opposite and parallel to the panel edge 212B and the panel edge 212C is substantially opposite and parallel to the panel edge 212D.

Preferably, the panel edges 210A, 210B have a length substantially equal to the length of the panel edges 204A, 204B. The panel edges 204A, 204B preferably have a length substantially equal to the length of the panel edges 212A, 212B. In addition, the panel edges 212A, 212B preferably have a length substantially equal to the length panel of the edges 206A, 206B. Furthermore, the panel edges 210C, 210D have a length substantially equal to the length of the panel edges 212C, 212D.

The adjacent wall panel 214 is substantially trapezoidal in shape. The adjacent wall panel 214 has a base edge 224, a pair of side edges 226, 228, a top edge 230 and a playing side 229. The adjacent wall panel 214 also includes a back side 231 as illustrated in FIG. 14. Referring to FIG. 9, the side edge 226 is approximately the same length as the side edge 228 and the top edge 230 has a length shorter than the length of the base edge 224. In addition, the base edge 224 has a length substantially equal to the length of the panel edge 206B, and the distance between the base edge 224 and the top edge 230 is approximately equal to the length of the panel edges 212C, 212D.

The end wall panel 216 includes a plurality of end panel edges 216A, 216B, 216C, 216D and a playing side 216E. The end panel edge 216A is substantially opposite and parallel to the end panel edge 216B and the end panel edge 216C is substantially opposite and parallel to the end panel edge 216D.

The end wall panel 218 includes a plurality of end panel edges 218A, 218B, 218C, 218D and a playing side 218E. The end panel edge 218A is substantially opposite and parallel to the end panel edge 218B and the end panel edge 218C is substantially opposite and parallel to the end panel edge 218D.

The end panel edges 216A, 216B and the end panel edges 218A, 218B preferably have a length substantially equal to the length of the panel edges 208C, 208D.

The gusset panels 220, 222 in the third preferred embodiment are substantially triangular in shape. The gusset panel 220 includes a plurality of gusset panel edges 220A, 220B, 220C and a playing side 220D. The gusset panel edge 220A has a length substantially equal to the length of the side edge 228 of the adjacent wall panel 214.

The gusset panel 222 includes a plurality of gusset panel edges 222A, 222B, 222C and a playing side 222D. The gusset panel edge 222A has a length substantially equal to the length of the side edge 226 of the adjacent wall panel 214.

The gusset panel edges 220B, 220C have a length substantially equal to the length of the gusset panel edges 222B, 222C. Furthermore, the gusset panel edges 220B, 220C, 222B, 222C have a length substantially equal to the panel edges 216C, 218C.

To form the game board system 200 of the third preferred embodiment of the present invention, first, the adjacent wall panel 210 is hinged to the side wall panel 204 along the panel edge 210B and the panel edge 204A forming a hinge line 232. Second, the side wall panel 204 is hinged to the adjacent wall panel 212 along the panel edge 204B and the panel edge 212A forming a hinge line 234. Next, the adjacent wall panel 212 is hinged to the side wall panel 206 along the panel edge 212B and the panel edge 206A forming a hinge line 236. Then, the side wall panel 206 is hinged to the adjacent wall panel 214 along the panel edge 206B and the base edge 224 forming a hinge line 238. Finally, the adjacent wall panel 214 is hinged to the side wall panel 208 along the top edge 230 and the panel edge 208A forming a hinge line 240.

In addition to hingedly connecting the side wall panels as detailed above, the end panel 216 is preferably hinged to the side wall panel 208 along the end panel edge 216A and the panel edge 208D forming a hinge line 242 and the end panel 216 is preferably hinged to the gusset panel 220 along the end panel edge 216C and the gusset panel edge 220B forming a hinge line 244. Additionally, the end panel 218 is preferably hinged to the side wall panel 208 along the end panel edge 218A and the panel edge 208C forming a hinge line 246 and the end panel 218 is preferably hinged to the gusset panel 222 along the end panel edge 218C and the gusset panel edge 222B forming a hinge line 248. Furthermore, the gusset panel 220 is preferably hinged to the adjacent wall panel 214 along the gusset panel edge 220A and the side edge 228 forming a hinge line 250 and the gusset panel 222 is preferably hinged to the adjacent wall panel 214 along the gusset panel edge 222A and the side edge 226 forming a hinge line 252.

To fold the game board system 200 of the third preferred embodiment of the present invention, as illustrated in FIG. 10, the side wall panel 208 is folded upwardly along the hinge line 240 toward the playing side 229 of the side wall panel 214. As the side wall panel 208 is folded, the end panels 216, 218 fold inwardly, along the hinge lines 242, 246, respectively, toward the playing side 208E of the side wall panel 208 to a point such that the end panels 216, 218 are perpendicular to the side panel 208 and the adjacent wall panel 214 is perpendicular to both the side wall panel 208 and the end panels 216, 218. As illustrated in FIG. 11, after folding, the gusset panels 220, 222 are perpendicular to both the side wall panel 208 and the end panels 216, 218 and the playing sides 220D, 222D rest against the playing side 229 of the adjacent wall panel 214.

Figure 12:
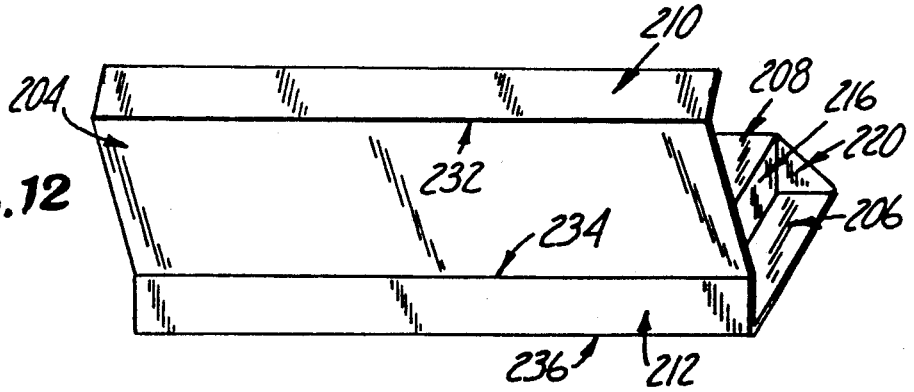

As illustrated in FIG. 10, the side wall panel 208, the adjacent wall panel 214 and the end walls 216, 218, collectively, are then folded along the hinge line 238 such that the end panel edges, 216B, 218B and the gusset panel edges 220C, 222C rest against the playing side 206E of the side wall panel 206 as is illustrated in FIG. Next, as illustrated in FIGS. 11-13, the adjacent wall panel 212 is folded upwardly along the hinge line 236 until the panel edge 208B and end panel edges 216D, 218D rest against the playing side 212E of the adjacent wall panel 212. Then, the side wall panel 204 is folded along the hinge line 234 until the playing side 204E of the side wall panel 204 rests against the back side 208F of the side wall panel 208. Finally, the adjacent wall panel 210 is folded along the hinge line 232 until the playing side 210E of the adjacent wall panel 210 rests against the back side 231 of the adjacent wall panel 214.

In this particular embodiment, as illustrated in FIG. 14, the game board system 200 forms a substantially rectangular cross-sectional configuration. It is also within the scope of the present invention to have end panels which are not only triangular and rectangular, but also trapezoidal and other varied symmetries.

Depending on the number of side wall panels and the shape of the end panels, the container created by the folded game board of the present invention is capable of attaining an infinite number of geometric cross-sectional configurations. For example, with an infinite number of side wall panels with an infinite number of fold lines, the cross-sectional configuration would be circular or semicircular.

The many different configurations achievable by the game board system 10 of the present invention provides a game manufacturer the opportunity for that manufacturer's game board to have a cross-sectional shape different from other manufacturers or competitors, thus giving the game a unique appearance. In addition, configurations may be developed to aid in stacking the games in storage or on store retail shelves. Configurations can also be chosen to associate a game with a game producer so as to function as a trademark.

The hinge connections between the side panels, the end panels and the gusset panels are capable of being formed from various hinging mechanisms. For purposes of discussion only, the hinge connections will be described below with reference to the first embodiment only. The same types of hinge connections are also applicable to the second and third embodiments.

Preferably, a continuous game playing surface 62 overlays the playing side 16 of the game board 14, as best illustrated in FIG. 15. The game playing surface 62 hingedly connects the separate side wall panels 20, 22, 24, 26 and the end panels 28, 30. A reinforcement sheet can be added under the game playing surface 62 to reinforce the hinge connection, if desired. In addition, the use of the game playing surface 62 as the hinge eliminates the need for other types of external mechanical hinges which, although within the scope of the present invention, would have to be provided at additional cost to the manufacturer.

A continuous back surface 64 overlays and is securely affixed to the back side 22 of the game board 14. Preferably, the back surface 64 is connected to the game playing surface 62 between each of the side wall panels 20, 22, 24, 26, as best illustrated in FIG. 16. The connection between the back surface 64 and the game playing surface 62 provides an additional type of hinge connection for providing a more durable hinge than would be possible with just the game playing surface 62 alone.

In yet another embodiment of the hinge connection the present invention, as illustrated in FIG. 17, the side wall panels 20, 22, 24, 26 and the end panels 28, 30 are formed from a single sheet of material. For purposes of illustration only, just side wall panels 20 and 22 are illustrated. The side wall panel 20 is hinged to the side wall panel 22 at a fold line 42. The fold line 42 can be scored to provide for easier folding of the panels.

It should be noted that the above detailed embodiments of the hinging of the side wall panels 20, 22, 24, 26 and the end panels 28, 30 are combinable within the same game board 14. For example, the side wall panel 20 is hinged to the side wall panel 22 by the hinge connection 46 formed by the playing surface 62 and the back surface 64 while the end panels 28, 30 are hinged to the side wall panels 26 by the playing surface 62 only. Other combinations are also within the scope of the present invention.

Not only can the various types of hinging mechanisms be combined within the same game board 14, the hinges can also be of different width. For example, in the first embodiment of the game board 14, the hinge connection between side wall panel 20 and side wall panel 22 formed by the playing surface 62 and the back surface 64 preferably has a width of approximately 0.38 inches. The hinge connection between the side wall panel 22 and the side wall panel 24 and the hinge connection between the side wall panel 24 and the side wall panel 26 formed by the playing surface 62 and the back surface 64 preferably have a width of approximately 0.25 inches. The purpose of the various widths is to allow easy folding of the game board 14 of the first embodiment into the triangular cross-section configuration.

The game board 14 when lying flat does not necessarily have to be of a rectangular configuration but may be of any preferable geometric shape such as elliptical or trapezoidal. It should be understood that other geometrical shapes may dictate a different number of side wall panels and end panels, but in all configurations, the game board is foldable into a container to form an enclosure.

Since the game board 14 itself becomes the container 44 which holds the loose game pieces 12, a separate box, normally consisting of top and bottom sections that slip together, is no longer necessary. By using the game board system 10 of the present invention, game producers will gain the advantages of having a sturdier and more durable container (as the game board is of a greater thickness of material than the outer box), less materials cost due to no outer box, less shipping damage due to the sturdier and more durable container, and the satisfaction that they are lessening the adverse effect on the environment by reducing paper consumption.

The retailer will benefit using the game board system 10 of the present invention by having more shelf space due to the reduced size. Inventory cost should be less due to the reduced price.

Purchasers and users of the game board system 10 will be benefitted in that the users will have a more convenient way to store the user's game board. Worn out boxes will no longer be a bother. The games will take up less space at the user's home, and with the reduced cost of the product to the manufacturers, the user could possibly pay less for the game.

Although the present invention has been described with reference to preferred embodiments, workers skilled in the art will recognize that changes may be made in form and detail without departing from the spirit and scope of the invention.

What is claimed is:

1. An enclosure system, the system comprising:

a plurality of side wall panels and at least one end panel, at least one of said side wall panels and said end panel each having outer edges defining a perimeter of the system unfolded, each of the side wall panels hinged to at least one adjacent side wall panel, whereby at least one of the end panels is hinged to at least one of the side wall panels and whereby the system folds into a container forming an enclosure; and wherein said end panel folds upward with respect to the outer edges of the side wall panels such that the outer edge of the end panel faces toward an inside surface of the side wall panels in a closed enclosure relationship with the side wall panels such that items within the enclosure are retained within the enclosure.

2. The enclosure system of claim 1 wherein the side wall panels include four side wall panels and there are two end panels.

3. The enclosure system of claim 2 wherein three of the side wall panels are rectangular, one of the side wall panels is trapezoidal and the end panels are triangular, the trapezoidal side wall panel having a base edge, a top edge parallel to the base edge, a first side edge and a second side edge, the angle between the first side edge and the base edge and the angle between the second side edge and the base edge each being approximately 45°.

4. The enclosure system of claim 3 wherein the three rectangular side wall panels include a first side wall panel, a second side wall panel and a third side wall panel, the first side wall panel being hinged to the second side wall panel, the second side wall panel being hinged to the third side wall panel and the third side wall panel being hinged to the base edge of the trapezoidal side wall panel.

5. The enclosure system of claim 4 wherein the two end panels include a first end panel and a second end panel wherein further the first end panel is hinged to the first side edge of the trapezoidal side wall panel and the second end panel is hinged to the second edge of the trapezoidal side wall panel, thereby together forming a fourth side wall panel, the fourth side wall panel being rectangular shaped.

6. The enclosure system of claim 5 wherein the first side wall panel has a first side wall panel length and a first side wall panel width, the second side wall panel has a second side wall panel length and a second side wall panel width, the third side wall panel has a third side wall panel length and a third side wall panel width, and the fourth side wall panel has a fourth side wall panel length and a fourth side wall panel width, the first side wall panel length being substantially equal to each of the second, the third and the fourth side wall panel width, the first side wall panel width and the fourth side wall panel width each being approximately equal to 0.268 times the first side wall panel length, and the second side wall panel width and the third side wall panel width each being approximately equal to 0.232 times the first side wall panel length.

7. The enclosure system of claim 1 wherein the side wall panels include four side wall panels and there are four end panels.

8. The enclosure system of claim 7 wherein two of the side wall panels are trapezoidal, two of the side wall panels are rectangular and the end panels are triangular, the two trapezoidal side wall panels comprising:

a first trapezoidal side wall panel having a first base edge, a first top edge parallel to the first base edge, a first side edge and a second side edge, the angle between the first side edge and the first base edge and the angle between the second side edge and the first base edge each being approximately 49°;

a second trapezoidal side wall panel having a second base edge, a second top edge parallel to the second base edge, a third side edge and a fourth side edge, the angle between the third side edge and the second base edge and the angle between the fourth side edge and the second base edge each being approximately 49°;

wherein the first base edge has length and the second base edge has a length, the length of the first base edge being approximately equal to the length of the second base edge; and wherein the first top edge has a length and the second top edge has a length, the length of the first top edge being approximately equal to the length of the second top edge.

9. The enclosure system of claim 8 wherein the two rectangular side wall panels include a first side wall panel and a fourth side wall panel, the four end panels include a first end panel, a second end panel, a third end panel and a fourth end panel.

10. The enclosure system of claim 9 wherein the first end panel is hinged to the first side edge of the first trapezoidal side wall panel, the second end panel is hinged to the second side edge of the first trapezoidal side wall panel, the third end panel is hinged to the third side edge of the second trapezoidal side wall panel and the fourth end panel is hinged to the fourth side edge of the second trapezoidal side wall panel, wherein further the first end panel, the second end panel and the first trapezoidal side wall panel together form a second rectangular side wall panel and the third end panel, the fourth end panel and the second trapezoidal side wall panel together form a third rectangular side wall panel.

11. The enclosure system of claim 10 wherein the first side wall panel is hinged to the base edge of the first trapezoidal side wall panel, the top edge of the first trapezoidal side wall panel is hinged to the top edge of the second trapezoidal side wall panel, the base edge of the second trapezoidal side wall panel is hinged to the fourth side wall panel, the first end panel is hinged to the third end panel and the second end panel is hinged to the fourth end panel.

12. The enclosure system of claim 11 wherein the first side wall panel has a first side wall panel length and a first side wall panel width, the second side wall panel has a second side wall panel length and a second side wall panel width, the third side wall panel has a third side wall panel length and a third side wall panel width, and the fourth side wall panel has a fourth side wall panel length being substantially equal to each of the second, the third and the fourth side wall panel lengths of the first, second, third, fourth side wall panel widths each being approximately equal to 0.25 times the first side wall panel length.

13. The enclosure system of claim 1 wherein the side wall panels include five side wall panels, one last side wall panel, and there are two end panels and two gusset panels.

14. The enclosure system of claim 13 wherein four of the side wall panels, the last side wall panel and the end panels are rectangular, one of the side wall panels are trapezoidal and the gusset panels are triangular.

15. The enclosure system of claim 14 wherein further the four side wall panels include a first side wall panel, a second side wall panel, a third side wall panel and a fourth side wall panel, the two end panels include a first end panel and a second end panel, the two gusset panels include a first gusset panel and a second gusset panel and the trapezoidal side wall panel has a base edge, a top edge, a first side edge and a second side edge.

16. The enclosure of claim 15 wherein the first side wall panel is hinged to the second side wall panel, the second side wall panel is hinged to the third side wall panel, the third side wall panel is hinged to the fourth side wall panel, the fourth side wall panel is hinged to the base edge of the trapezoidal side wall panel and the top edge of the trapezoidal side wall panel is hinged to the last side wall panel.

17. The enclosure system of claim 16 wherein the first gusset panel is hinged to the first side edge of the trapezoidal side wall panel and the second gusset panel is hinged to the second side edge of the trapezoidal side wall panel thereby together forming a fifth rectangular side wall panel.

18. The enclosure system of claim 17 wherein the first end panel is hinged to the last side wall panel and the first gusset panel and the second end panel is hinged to the last side wall panel and the second gusset panel.

19. The enclosure system of claim 1 and further including a first sheet forming a front surface overlaying the side and end panels and hingedly connecting each side wall panel to at least one adjacent side wall panel and at least one of the end panels to at least one of the side wall panels.

20. The enclosure system of claim 19 and further including a second sheet forming a back surface overlaying the side wall panels and at least one of the end panels wherein the second sheet is connected to the first sheet between each of the side wall panels and at least one of the end panels thereby hinging each of the side wall panels to an adjacent side wall panel and hinging at least one of the end panels to at least one of the side wall panels.

21. The enclosure system of claim 1 wherein the side wall panels and at least one of the end panels are formed from a single sheet of material, the side wall panels being hinged to at least one of the adjacent side wall panels by fold lines and at least one of the end panels being hinged to at least one side wall panel by fold lines.

22. The enclosure system of claim 1 and a plurality of foldable gusset panels, each gusset panel being hinged to at least one of the side wall panels and to at least one of the end panels.

23. The enclosure system of claim 1 and a fastening mechanism attached to the back side of the playing surface to secure the side wall panels of the container.

24. The enclosure system of claim 1 wherein an edge of the end panel engages at least one of the side wall panels thereby retaining the end panel in the closed enclosure relationship with the side wall panels.

25. The enclosure system of claim 1 wherein the end panel is recessed sufficiently from an edge of at least one of the side wall panels thereby retaining the end panel in the closed enclosure relationship with the side wall panels.

26. A method of forming an enclosure in a container, the method comprising:

providing a foldable board having a plurality of side wall panels and at least one end panel, at least one of said side wall panels and said end panel each having outer edges defining the perimeter sides of the foldable board, each of the side wall panels hinged to at least one adjacent side wall panels, at least one of the end panels hinged to at least one of the side wall panels;

folding at least one of the end panels upward with respect to the outer edge of at least one of the side wall panels thereby causing at least one of the side wall panels to fold upward wherein at least one of the end panels and the upward folded side wall panels form an initial storage cavity; and folding the side wall panels around at least one of the end panels such that the outer edge of said end panel faces toward an inside surface of the side wall panels thereby forming the enclosure in the container.

27. The method of claim 26 and further including a plurality of foldable gusset panels, each gusset panel being hinged to at least one of the side wall panels and to at least one of the end panels wherein as at least one of the end panels is folded upward, the gusset panels fold inward with respect to the side wall panels and at least one of the end panels.

28. The method of claim 26 wherein the foldable board includes two rectangular side wall panels, two trapezoidal side wall panels and four end panels, wherein the trapezoidal side wall panels and the end panels are folded upwardly with respect to the rectangular side wall panels and the rectangular side wall panels are folded downwardly with respect to the trapezoidal side wall panels and the end panels.

29. The method of claim 26 wherein the foldable board include four rectangular side wall panels, one trapezoidal side wall panel, one last side wall panel, two end panels and two gusset panels, wherein the end panels are folded upward with respect to the last side wall panel thereby folding the trapezoidal side wall panel and the rectangular side wall panels upward and then folding the trapezoidal side wall panel upward with respect to the rectangular side wall panels.

* * * * *

UNITED STATES PATENT AND TRADEMARK OFFICE

CERTIFICATE OF CORRECTION

PATENT NO. : 5,178,396

DATED : January 12, 1993

INVENTOR(S) : MARK D. LYON, CHARLES W. GIRSCH

It is certified that error appears in the above-identified patent and that said Letters Patent is hereby corrected as shown below:

Col. 12, line 2, delete "width" (first occurrence), insert "lengths"

Col. 12, line 28, before "length", insert "a"

Col. 13, line 1, after "wall", insert "panel length and a fourth side wall panel width, the first side wall"

Col. 13, line 4, delete "of", insert "and"

Col. 13, line 13, delete "are", insert "is"

Signed and Sealed this

Twenty-sixth Day of October, 1993

*Attest:*

Bruce Lehman

BRUCE LEHMAN

*Attesting Officer*

*Commissioner of Patents and Trademarks*